US005454571A

United States Patent [19]

Morrison

[11] Patent Number: 5,454,571

[45] Date of Patent: Oct. 3, 1995

[54] GAME APPARATUS FOR RELEASABLY HOLDING A GAME OBJECT

[76] Inventor: Steve Morrison, 6730 Morro St., Salt Lake City, Utah 84121

[21] Appl. No.: 333,280

[22] Filed: Oct. 2, 1994

[51] Int. Cl.[6] ..... F41J 1/10

[52] U.S. Cl. ..... 273/407

[58] Field of Search ..... 116/173, 174, 116/175; 273/348, 407

[56] References Cited

U.S. PATENT DOCUMENTS

| | | | |
|---|---|---|---|
| 2,538,118 | 1/1951 | Miller | 273/407 |
| 3,216,728 | 11/1965 | Whitney | 273/177 |
| 4,092,081 | 5/1978 | Schmanski | 404/10 |
| 4,662,305 | 5/1987 | Cline | 116/173 |
| 4,913,389 | 4/1990 | McCracken | 273/407 X |
| 5,303,931 | 4/1994 | Brown | 273/348 |

*Primary Examiner*—William H. Grieb
*Attorney, Agent, or Firm*—Thorpe North & Western

[57] ABSTRACT

A game apparatus is disclosed including a support post and an attachment mechanism which may be attached to and removed from the support post. The attachment mechanism releasably holds a piece of material so that the material can be easily attached to and removed from a position adjacent the support post, thereby facilitating the playing of games such as Steal The Flag. The attachment mechanism is designed to allow a player of the game to take the piece of material without contacting the support post, thereby decreasing the chance that a player might be injured. In addition to its use for games such as Steal The Flag, the apparatus can also be used as a boundary marker for other types of games and competitions.

17 Claims, 2 Drawing Sheets

GAME APPARATUS FOR RELEASABLY HOLDING A GAME OBJECT

BACKGROUND OF THE INVENTION

The present invention relates to an apparatus for use in games and, in particular, for use in games involving possession of a game object such as a flag or other piece of material and in games which have set boundaries.

There are numerous games which involve the possession and/or removal of a flag or piece of material belonging to an opposing player or team. In such games, the object is usually for one player/team to dispossess the opposing player/team of their flag before the opposing player/team is capable of doing the same. One such game is commonly referred to as Steal The Flag. In this game, the players are divided into two opposing teams with generally defined territories. Each team places its flag within its territory in such a location that it will be difficult for the opposing team to find the flag. Some members of the team remain in the territory to guard the flag, while other members of the team venture into the opposing team's territory in an attempt to find and remove the opposing team's flag. Those venturing into the opposing team's territory must usually remove the flag without being "tagged" or otherwise identified by the opposing team. Generally, the first team to remove the opposing team's flag and return with it to their own territory is considered the winner.

Such games are commonly played with a piece of fabric which is tied, or otherwise fastened, to a support post, such as a wooden stick which is driven into the ground, thus designating a team's flag. When an opposing team member finds the flag, it is usually faster for the player to capture the flag by simply grabbing the stick supporting the flag and running to his/her own territory. Such a situation, however, creates problems. For example, if the player is tagged or otherwise identified by the opposing team before returning to his/her own territory, the flag must usually be returned to its original position. This is often difficult, however, as the entire support post for the flag has been removed from the ground and must once again be hammered or otherwise secured into the ground so as to support the flag.

Another, more significant problem is the danger inherent in running with the support post, which is often pointed at one end so as to facilitate entry into the ground. As the player runs to avoid being tagged or otherwise identified, he/she may trip or otherwise cause the support post to come into contact with himself/herself or another player. When the players are running at high speeds, a misdirected post can cause serious bodily injury to the player struck.

Thus, there is a need for an apparatus for use with games such as Steal The Flag, and other games involving the possession of a piece of material in which the material can be easily removed and reattached to the support post thereby minimizing the risk of injury to players.

OBJECTS AND SUMMARY OF THE INVENTION

It is an object of the present invention to provide a new and improved game apparatus for use, among others, with Steal The Flag and similar games involving the dispossession of a piece of material from an opposing team.

It is an additional object of the invention to provide an attachment mechanism whereby a flag or similar piece of material can be releasably attached to the support post.

It is still another object of the invention to provide a boundary marker for games.

The above and other objects of the invention are realized in specific illustrated embodiments of a game apparatus including a generally elongate support post having a first end for affixing the support post in the ground and a second end for holding an attachment mechanism. The game apparatus also includes an attachment mechanism having a first end for attachment to the support post and a second end for releasably holding a flag or similar piece of material.

In accordance with one aspect of the invention, the elongate support post is formed from a resilient or semi-resilient material so as to decrease the risk of injury in the event that a person forcibly contacts the post. Likewise, the attachment device may also be made of a resilient material to lessen the risk of injury should it come into forceful contact with a player.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
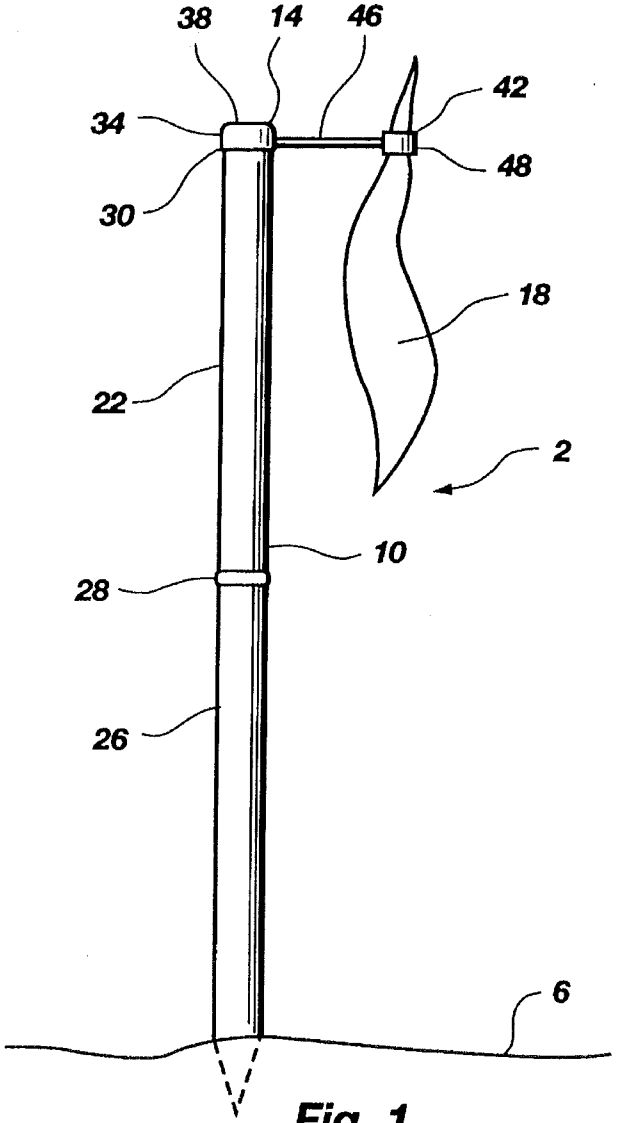
FIG. 1 is a perspective view of a game apparatus made in accordance with the principles of the present invention, showing a support post embedded in the ground and supporting an attachment mechanism and a flag.

Reference will now be made ,to the drawings in which the structures embodying the principles of the present invention will be given numeral designations. Referring to FIG. 1, there is shown a game apparatus, generally indicated at 2, which extends upwardly from the ground 6. The game apparatus 2 includes a support post 10, an attachment mechanism 14, and a flag 18. As shown in FIG. 1, the support post 10 is driven into the ground 6 so that the ground will hold the support post 10 in a generally vertical position. This can be done either with a hammer or, if the ground 6 is soft enough, simply by pushing the lower end of the support post 10 into the ground.

The support post 10 can form a single piece, or can comprise an upper portion 22 and a lower portion 26, each of the two portions being an individual elongate pole. The upper and lower portions, 22 and 26 respectively, are held together by a connector 28 which extends into each portion and can be unattached so that the support post 10 may be disassembled for easy carrying. When attached together, the collective length of the upper and lower portions, 22 and 26 respectively, should ideally be between three feet and six feet, keeping the flag 18 within convenient reach of the players.

Attached to an upper-most end 30 of the upper portion 22 is the attachment mechanism 14 which attaches the support post 10 to a flag 18. The attachment mechanism 14 includes a first end 34 which forms a cap 38 at the upper-most end 30 of the support post 10. The cap 38 holds the attachment mechanism 14 to the support post 10. The cap 38 is preferably made of a resilient material, such as rubber or plastic. By covering the upper-most end 30 of the support post 10, the cap 38 prevents a player from coming into forceful contact with the often rigid end of the support post 10, thereby decreasing the risk of injury. Those skilled in the art, however, will recognize that the attachment mechanism 14 could use a resilient ring or other method for holding the attachment mechanism to the support post 10.

A second end 42 of the attachment mechanism 14 has a clip or other type of holder 48 for securing the flag 18. While the second end 42 could be disposed immediately adjacent to the first end 34, the two ends 34 and 42 are preferably spaced apart by an arm 46 so that a player need not touch the support post 10 when removing the flag 18. The holder 48 preferably includes a plurality of resilient teeth (not shown) which will hold the flag 18, but allow the flag to be removed with a quick pull. Typically, the teeth are made of a resilient material, as is the arm 46, both to prevent injury to players and to facilitate attachment and removal of the flag.

In use, a player will run past the apparatus 2 and grab the flag 18. Due to the resilient nature of the attachment mechanism 14, the flag 18 may be pulled from the holder 48 and carried by the player. In the event that the player is caught before returning to his/her own territory, the flag 18 can be quickly and easily reattached to the attachment mechanism 14 by sliding a portion of the flag between the teeth of the holder 48.

Figure 2:
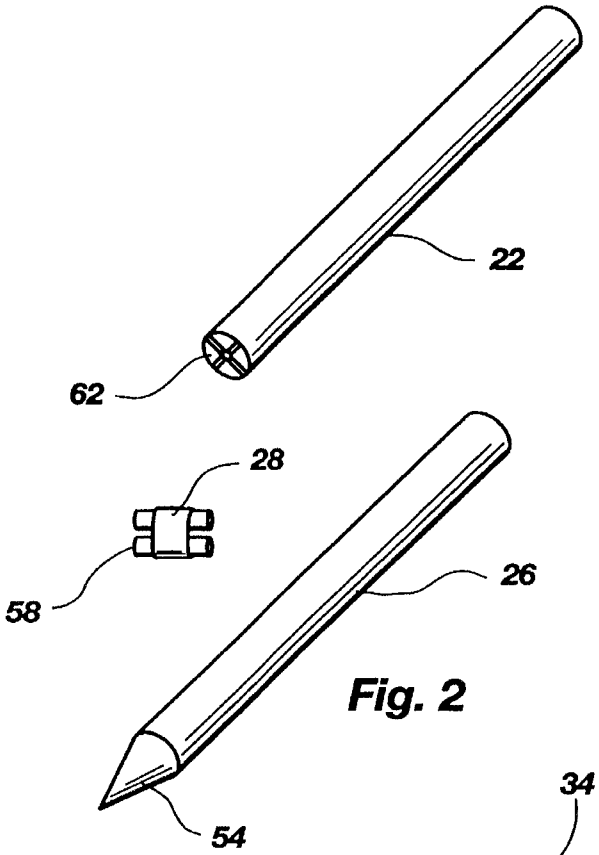
FIG. 2 is a perspective view of a disassembled support post made in accordance with the principles of the present invention.

Referring now to FIG. 2, there is shown a perspective view of a disassembled support post 10, including the upper portion 22 and the lower portion 26. The lower portion 26 includes a cone-shaped ending 54 or similar device for securing the support post 10 in an upright position. Because the cone-shaped ending 54 will generally be somewhat sharp, it is recommended that players not attempt to remove the support post 10 during the game.

The lower portion 26 is attached to the upper portion 22 by the connecter 28. This is accomplished by nesting projections of the connector 28 within a respective portion. For example, projection 58 would nest within channel 62 in the upper portion 22. For the arrangement shown in FIG. 2, the connector 28 would have four projections on each side to nest within the four channels on each portion. By removing the connector 28 from one of the portions, 22 or 26, the support post 10 can be disassembled, making the support post 10 easy to carry or store. Those skilled in the art will recognize that with minor modifications to the connector, the support post 10 could be made to pull apart easily, allowing a player to take an upper portion 22 instead of just the flag. Such an arrangement, however, would lack some of the safety advantages discussed above.

As shown in FIG. 2, each of the poles comprising the upper and lower portions, 22 and 26 respectively, will typically have a generally round cross-section. However, those skilled in the art will recognize that virtually any cross-section shape could be used while achieving the advantages of the present invention.

The support post 10 can be made of virtually any firm material. For example, the support post 10 can be made of metal or plastic. As anticipated, the support post 10 will most often include an extruded plastic which has some lateral flexibility. While the support post must be sufficiently rigid to enter into the ground, a material such as a fiber-reinforced thermal-resin, which allows for longitudinal rigidity and latitudinal flexibility is preferred so as to decrease the risk of injury in the event that a player runs into the support post 10. Such combinations are discussed in U.S. Pat. No. 4,092,081 which is expressly incorporated herein. Such rigid\flexible materials allow the support post 10 to be hammered into the ground, but also allow the post to bend in the event that a player accidentally hits the side of the support post. By bending, the support post 10 is less likely to injure a player.

Figure 3:
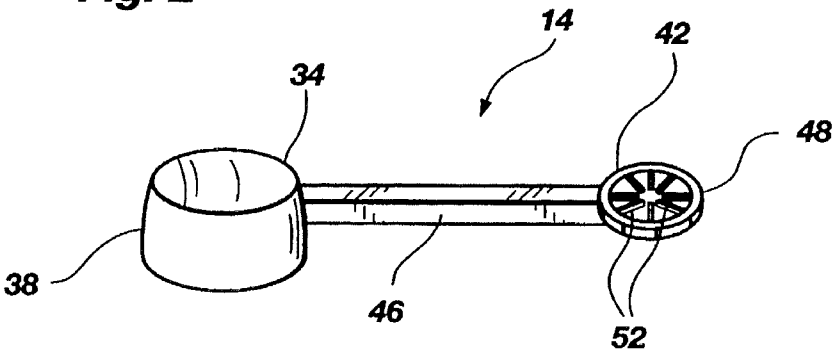
FIG. 3 is a close-up perspective view of the attachment device of FIG. 1 showing greater detail.

Referring now to FIG. 3, there is shown an attachment mechanism 14 for attaching the flag (not shown) to the support post (not shown). The attachment mechanism 14 includes a cap 38, an arm 46, and a holder 48. As was mentioned above, the cap 38 fits over the uppermost end 30 of the support post 10 both to hold the attachment mechanism 14 in place and to decrease the risk of injury should a player accidentally come into contact with the post.

The cap 38 could be replaced by a ring which would fit about the outside of the support post 10 (FIG. 1), but such an arrangement would lack the safety advantages discussed above in that the upper most end 30 (FIG. 1) would be exposed. The cap 38 could also be replaced by providing snaps to secure the arm 46 to the support post 10 or by forming the arm integrally with the support post.

The arm 46 will typically be between two inches and twelve inches long so as to keep the flag a sufficient distance from the support post 10. Thus, a player need not contact the support post when taking the flag.

The holder 48 has a plurality of resistant teeth 52 which will hold the flag in place, but allow the flag to be quickly pulled from the holder. The teeth 52 can be made of rubber or any number of resilient plastics. The flag is placed into the holder 48 by extending a corner of the flag through the teeth 52 and pulling on the corner from the opposite side.

Figure 4:
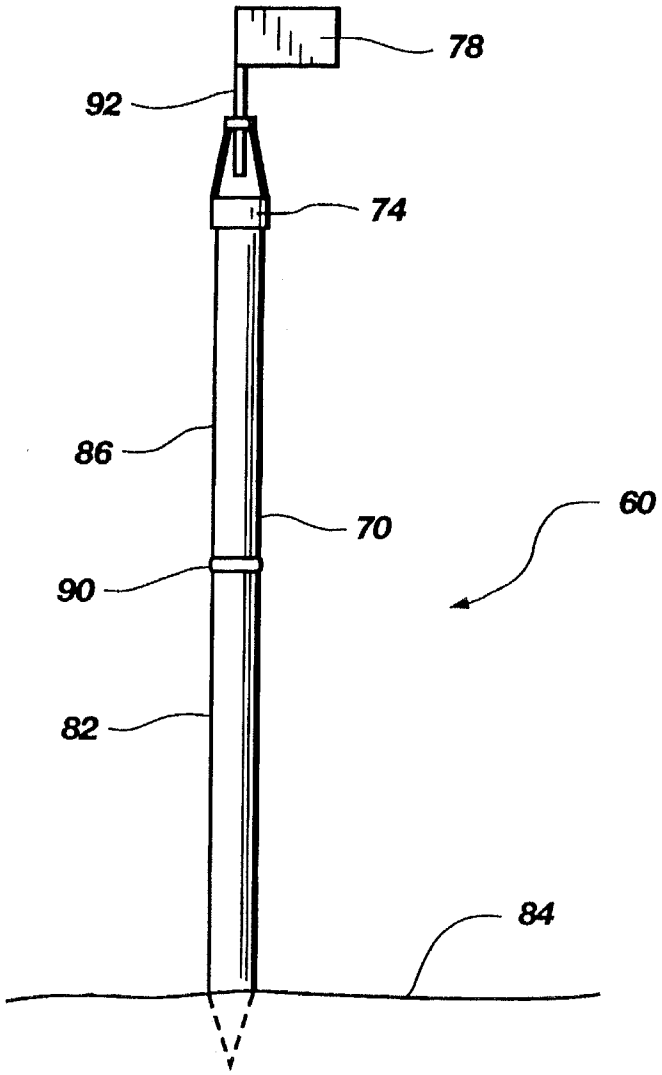
FIG. 4 is a side, elevational view of an alternate embodiment of the present invention in which a flag may be mounted atop an attachment mechanism which extends upwardly from a support post.

Referring now to FIG. 4, there is shown an alternate embodiment of the apparatus, generally indicated at 60, made in accordance with the present invention. The apparatus 60 includes a support post 70, an attachment mechanism 74 and a flag 78. The support post 70 is similar to the support post of FIGS. 1 and 2 in that it has multiple sections. A lower portion 82 of the support post 70 is secured in the ground 84. An upper portion 86 is connected to the lower portion 82 by a connector 90 and extends upwardly to support the attachment mechanism 74. The flag 78 is held by the attachment mechanism 74 directly above the support post 70.

While this arrangement lacks the desirable aspects of having the flag to the side of the support post, (as shown in FIG. 1 and discussed above), the arrangement shown in FIG. 4 allows the apparatus 60 to be used for several different purposes. For example, in addition to being usable for games such as Steal The Flag, the apparatus 60 can also be used as a boundary marker for games such as soccer or flag football. Thus, the apparatus 60 can be used to replace other types of markers, thereby reducing the overall equipment costs of institutions such as schools and sports leagues.

As shown in FIG. 4, the flag 78 is supported by a small pole 92 which fits into the attachment mechanism 74. This can be accomplished by providing the attachment mechanism 74 with a holder, such as holder 48 (shown in FIG. 3) or some other attachment device.

Figure 5:
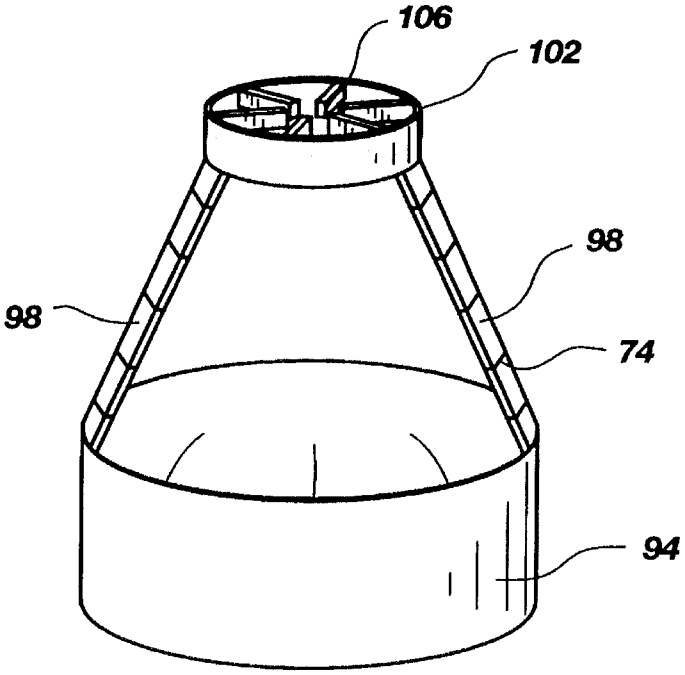
FIG. 5 is a perspective view of the attachment mechanism shown in FIG. 4 showing greater detail.

Referring now to FIG. 5, there is shown a more detailed view of the attachment mechanism 74 shown in FIG. 4. The attachment mechanism 74 includes a base 94 which is similar to the cap 38 (FIGS. 1 and 3). The base 94 nests over the uppermost end of the support post (not shown) so as to support the flag (not shown) and prevent contact with the upper most end of the support post (as shown in FIG. 4). Those skilled in the art will recognize that the base 94 could also be configured to nest within the support post, or could be attached to the support post in some other manner.

A pair of arms 98 extend upwardly from the base 94 to support a holder 102 positioned above the base. Preferably, the arms 98 are at least four inches long so that a player attempting to remove the flag will not accidentally hit the support post. While the arms 98 should be resilient, they should also be made of a material of sufficient firmness to keep the holder 102, and thus the flag, positioned above the support post, thereby enabling use of the apparatus 60 (FIG. 4) as a boundary marker for other games.

Similar to the holder 48 (shown in FIGS. 1 and 3), the holder 102 can have a plurality of teeth 106 for holding the pole 92 (FIG. 4). As will be apparent, such a configuration for the holder 102 would also allow the flag to be used without the pole 92.

In the manner described above, a game apparatus for releasably holding a game object is disclosed. The apparatus provides a safer way of playing games such as Steal The Flag, and also doubles as a boundary marker. It will be understood that other variations and modifications of the apparatus will be apparent to those skilled in the art without departing from the scope of the invention. The described embodiments of the apparatus are not meant to be a delineation of the scope of the invention, but merely examples of two embodiments thereof. The scope of the present invention is provided by the appended claims.

What is claimed is:

1. A game apparatus for releasably holding a piece of material, such as a flag, the apparatus comprising:

support means having upper and lower portions, the lower portion for disposition in the ground or other base so that the upper portion is maintained in a generally upright position; and attachment means disposed on the upper portion of the support means for releasably holding the piece of material adjacent said upper portion, the attachment means comprising a first attachment member and a second attachment member and at least one resilient arm disposed between the first attachment member and the second attachment member so as to space the second attachment member from the first attachment member.

2. The game apparatus for releasably holding a piece of material of claim 1, wherein the support means comprises a plurality of elongate poles, each pole being attachable to at least one other pole so as to form an elongate support post.

3. The game apparatus for releasably holding a piece of material of claim 2, wherein the support means further comprises a connector for connecting and holding elongate poles together so as to form the support post.

4. The game apparatus for releasably holding a piece of material of claim 1, wherein the support means comprises a support post formed of a lightweight thermo-resin.

5. The game apparatus for releasably holding a piece of material of claim 1, wherein the lower portion of the support means comprises a generally cone shaped ending extending downwardly so as to facilitate placement of at least a portion of the lower portion in the ground.

6. The game apparatus for releasably holding a piece of material of claim 1, wherein the first attachment member comprises a generally resilient cap for fitting over an uppermost end of the support means, so as to substantially enclose the uppermost end of the support means.

7. The game apparatus for releasably holding a piece of material of claim 1, wherein the first attachment member comprises a generally resilient ring for encircling a portion of the support means.

8. The game apparatus for releasably holding a piece of material of claim 1, wherein the second attachment member comprises a ring through which the piece of material can be pulled.

9. The game apparatus for releasably holding a piece of material of claim 8, wherein the attachment member further includes a plurality of resilient teeth extending inwardly from the ring so as to hold a portion of the piece of material within the ring.

10. The game apparatus for releasably holding a piece of material of claim 1, wherein the at least one arm of the attachment means holds the second attachment member between 2 inches and 12 inches from the support means.

11. The game apparatus for releasably holding a piece of material of claim 1, wherein the at least one arm is made of a resilient material so as to bend if force is applied to the second attachment member.

12. The game apparatus for releasably holding a piece of material of claim 1, wherein the at least one arm is disposed so as to position the second attachment member laterally from the first attachment member.

13. The game apparatus for releasably holding a piece of material of claim 1, wherein the at least one arm is disposed in an upward position so as to position the second attachment member above the first attachment member.

14. The game apparatus for releasably holding a piece of material of claim 13, wherein the attachment means comprises at least two arms disposed in an upward position so as to maintain the second attachment member in a position above the first attachment member when a flag is supported by the second attachment member.

15. The game apparatus for releasably holding a piece of material of claim 14, wherein the apparatus further comprises a flag and a pole connected to the flag and extending from the flag, the pole being nestable in the second attachment member.

16. A game apparatus for releasably holding a piece of material, such as a flag, the apparatus comprising:

support means including an upper pole, a lower pole and a connector for holding the upper pole and the lower pole together, the upper pole supporting the piece of material in a position above the ground, and the lower pole including a generally conical shaped ending for securing a lowermost portion of the lower pole in the ground and maintaining the support means in a generally upward position; and attachment means for releasably holding the piece of material adjacent to the upper pole of the support post, the attachment means including a resilient base/cap attachable to the upper pole of the support means, and a holder for releasably holding the piece of material.

17. A game apparatus for releasably holding a piece of material, such as a flag, the apparatus comprising:

support means for holding the piece of material above the ground, the support means having upper and lower portions held adjacent one another by a connector means so as to form an elongate pole, the upper portion supporting the piece of material in a position above the ground, and the lower portion including a holding means for securing the lower portion into the ground and maintaining the support means in a generally upright position; and attachment means for releasably holding the piece of material adjacent to the upper portion of the support means, the attachment means including a first attachment member attachable to the upper portion of the support means, a second attachment member for releasably holding the piece of material, and at least one arm for spacing the second attachment member between about 2 inches and 12 inches from the first attachment member.

* * * * *